US006715222B2

(12) United States Patent
Hecht

(10) Patent No.: US 6,715,222 B2
(45) Date of Patent: Apr. 6, 2004

(54) SELF-LIFTING ELECTRIC IRON

(75) Inventor: Gil Hecht, 30/18 Ahad Ha'am Street, Nahariya 22443 (IL)

(73) Assignees: Gil Hecht, Nahariya (IL); Iscar Ltd., Tefen (IL)

( * ) Notice: Subject to any disclaimer, the term of this patent is extended or adjusted under 35 U.S.C. 154(b) by 21 days.

(21) Appl. No.: 10/218,572

(22) Filed: Aug. 15, 2002

(65) Prior Publication Data

US 2003/0056408 A1 Mar. 27, 2003

(30) Foreign Application Priority Data

Sep. 2, 2001 (IL) ..... 145227

(51) Int. Cl.[7] ..... D06F 75/40
(52) U.S. Cl. ..... 38/79
(58) Field of Search ..... 38/79, 94, 96, 38/97, 80, 81, 88, 90; 219/245, 248, 249

(56) References Cited

U.S. PATENT DOCUMENTS

| | | | | | |
|---|---|---|---|---|---|
| 1,694,688 | A | * | 12/1928 | Panolfo | 38/79 |
| 2,076,614 | A | * | 4/1937 | Bowman | 38/74 |
| 2,149,251 | A | | 3/1939 | Campana | 219/25 |
| 2,211,839 | A | | 8/1940 | Simonsen | 38/79 |
| 2,224,896 | A | | 12/1940 | Burian | |
| 2,308,941 | A | | 1/1943 | Stevenson | 38/79 |
| 2,422,505 | A | | 6/1947 | Tangeman et al. | 38/96 |
| 2,422,856 | A | | 6/1947 | Schara | 219/25 |
| 2,596,314 | A | * | 5/1952 | Wales | 38/79 |
| 2,602,247 | A | | 7/1952 | Cochran | 38/79 |
| 2,664,655 | A | * | 1/1954 | Jepson | 38/79 |
| 2,668,379 | A | * | 2/1954 | Binggely | 38/79 |
| 2,713,224 | A | * | 7/1955 | Brace | 38/79 |
| 2,749,633 | A | | 6/1956 | Seck | 38/77 |
| 3,050,885 | A | | 8/1962 | Whitfield | 38/79 |
| 3,200,521 | A | | 8/1965 | Whitfield | 38/79 |
| 6,105,285 | A | | 8/2000 | Nickel | 75/38 |
| 6,260,295 | B1 | | 8/2001 | Nickel | 38/79 |
| 6,453,587 | B1 | * | 9/2002 | Alipour | 38/79 |

FOREIGN PATENT DOCUMENTS

| | | |
|---|---|---|
| DE | 394454 | 3/1924 |

* cited by examiner

*Primary Examiner*—Ismael Izaguirre
(74) *Attorney, Agent, or Firm*—Womble Carlyle

(57) ABSTRACT

A self-lifting electric iron having a handle and a soleplate and a support switch located on the handle. The iron has three retractable support rods capable of protruding beyond the soleplate to form a stand for supporting the iron in a horizontal stable position with the soleplate removed from the article being ironed or from an ironing board cover. The retractable support rods are operated by the support switch so that when the handle is not gripped the support rods protrude from the soleplate and when the handle is gripped during use the support rods are located within the iron.

19 Claims, 5 Drawing Sheets

SELF-LIFTING ELECTRIC IRON

FIELD OF THE INVENTION

This invention relates to electric irons for ironing clothing and other items, and specifically to electric irons that include safety mechanisms for causing the irons to lift away from operating surfaces whenever they are left unattended.

BACKGROUND OF THE INVENTION

Currently, most electric irons on the market are provided with a temperature adjustment function for the user to select the most favorable temperature for the material of the clothing. A thermostat will cut off power automatically when the iron reaches the required temperature. However, the thermostat is a passive safety feature. It only detects the temperature of the iron's soleplate, but it cannot prevent an accident that may be caused by carelessly leaving the iron in a horizontal position.

During the ironing process, it is often necessary that both the operator's hands be employed for manipulating the item being ironed or to remove the item and replace it with another. In such instances, the iron must be left un-held. If the iron is merely allowed to remain with the soleplate against the ironing board cover, sufficient heat will accumulate to raise the temperature beneath the iron to a level where the cover will sustain thermal damage such as scorching, burning or ignition. Furthermore, when there are frequent interruptions during ironing, as a result of which the iron may be accidentally left with the soleplate on the article being ironed resulting in thermal damage of that article. To avoid such damage, the heel portion of most irons is configured in a manner such that the iron can be balanced thereupon in an upright position, thereby removing the soleplate from contact with the article being ironed or with the ironing board cover. However, in such upright position, the iron is usually unstable with respect to toppling, and can easily fall off the ironing board. There are also known various types of irons equipped with means to automatically effect disengagement of the soleplate from contact with the article being ironed or with the ironing board cover when the iron is not being used by raising the iron into an inclined position intermediate between an upright position and a horizontal position.

None of the safety mechanisms mentioned above have come into widespread use primarily because in none of them is the resting position of the iron with the soleplate horizontal and therefore the need to repeatedly manipulate the iron from the horizontal working disposition to an upright or inclined temporary or storage disposition is in itself a tedious chore.

U.S. Pat. No. 6,105,285 describes a scorch prevention electric iron having two modes of operation during the ironing process, namely: a natural up-mode wherein the iron rides on a plurality of ball bearing glide assemblies with balls which extend from bores in the lower surface of the sole plate to hold the lower surface of the sole plate out of contact with the material being ironed; and a down-mode of operation wherein pressure upon the handle of the iron causes the balls of the ball bearing glide assembles to be retracted upwardly beyond the lower surface of the sole plate to allow the sole plate to engage the material being ironed. When the iron is in its natural up-mode of operation, it possesses the unique capability of steam ironing fabric materials such as nylon, silk, and rayon, which normally scorch or burn easily, without burning or scorching the material being ironed. When the iron is in its natural up-mode of operation, the iron rides or glides on the balls of ball bearing glide assemblies during the ironing process, with the sole plate being out of engagement with the material being ironed, to eliminate or reduce the possibility of the material being scorched or burned. When ironing material that is not easily scorched or burned as is nylon, silk or rayon, the user can apply pressure to the handle of the iron to place the iron in its down-mode of operation wherein the sole plate actually engages the material being ironed during the ironing process. When a user is not actually engaged in the ironing process, the user's release of the handle of the iron will cause the balls of the ball bearing glide assemblies to be extended beyond the lower surface of the sole plate to hold the sole plate out of contact with the material and/or the ironing board.

In this prior art iron, the balls of the ball bearing glide assemblies normally protrude beyond the under surface of the soleplate due to the urging of a compression spring in each bearing glide assembly. In order to iron material in the down-mode of operation, i.e., with the balls of the ball bearing glide assemblies retracted upwardly beyond the lower surface of the sole plate, a downward force has to be applied to the handle of the iron in order to overcome the forces in the compression springs. This downward force has to be applied constantly whilst ironing in this mode of operation. Furthermore, it is clear that in the down-mode of operation the balls will slightly protrude from the bores in the soleplate since ironing boards are always covered with a soft material. The soft material cannot withstand the compression forces in the springs and therefore the balls will be forced out of the bores in the soleplate by the compression springs compressing the soft material between the balls and the ironing board. Clearly, an item being ironed in this mode of operation will have marks produced on it by the balls. This is one disadvantage if this prior art iron. Another disadvantage is that when a user is not actually engaged in the ironing process, the user's release of the handle of the iron, i.e., the non-application of a downward force on the handle, will cause the balls of the ball bearing glide assemblies to be extended beyond the lower surface of the sole plate to hold the sole plate out of contact with the material and/or the ironing board. However, in this position the iron is adapted to ride or glide on the balls of the ball bearing glide assemblies and therefore will not be stable against horizontal forces.

SUMMARY OF THE INVENTION

It is an object of the present invention to provide a self-lifting electric iron that overcomes the above-mentioned disadvantages.

In accordance with the present invention there is provided a self-lifting electric iron comprising:

a body having a top and a bottom;

a soleplate comprising at least a portion of the bottom of the body, the soleplate having a bottom surface for ironing an article;

the bottom of the body being provided with a plurality of retractable support rods that are movable from a first position in which the retractable support rods protrude from the bottom of the body beyond the bottom surface, forming a stand for supporting the iron in a horizontal stable position with the soleplate removed from the article being ironed or from an ironing board cover, to a second position in which the plurality of retractable support rods are located within the body;

a handle at the top of the body, to be gripped during use; and a support switch located on the handle with the support switch being in a first state and the plurality of retractable support rods in the first position when the handle is not gripped, and when the handle is gripped the support switch changes state to a second state and the plurality of retractable support rods move to the second position.

In accordance with a preferred embodiment of the present invention, the plurality of retractable support rods comprises three retractable support rods.

Preferably, one support rod of the three retractable support rods is located at a front end of the iron and two retractable support rods of the three retractable support rods are located at a rear end of the iron.

In accordance with a first embodiment of the present invention, when the three retractable support rods are in the first position, each of the retractable support rods protrudes through a bore in the soleplate.

If desired, the three retractable support rods are made of a thermally insulating material.

In accordance with a second embodiment of the present invention, when the retractable support rods are in the first position, the one support rod located at the front end of the iron protrudes through a bore in the soleplate, and the two retractable support rods located at the rear of the iron protrude from a portion of the bottom of the body exterior to the soleplate.

Quite generally, in the first position each support rod has a free end distal the soleplate and if desired, each support rod is provided with a thermally insulating member attached to the free end thereof, the thermally insulating member having a generally planar support surface for abutting the article being ironed or the ironing board cover and for supporting the iron, when the support rod is in the first position.

Preferably, when each support rod is in the second position, the support surfaces are substantially flush with the bottom surface of the soleplate.

In accordance with present invention, each support rod is mounted in a housing for reciprocatory movement with respect to the housing, with the plurality of retractable support rods being maintained in the first position by means of at least one biased spring, and with the plurality of retractable support rods being moved from the first position to the second position by means of at least one actuating member.

In accordance with a first specific application, the at least one biased spring comprises a plurality of first springs, each support rod of the plurality of retractable support rods being in operative association with a separate single first spring of the plurality of first springs, and the at least one actuating member comprises a plurality of support units.

Typically, each support unit has a longitudinal axis and comprises the housing, the housing having a upper and lower ends, with a generally cylindrical longitudinally extending chamber, extending from the upper end of the housing to the lower end of the housing, an air outlet at the upper end of the housing and a circular opening at the lower end of the housing, the support rod being located in the chamber and reciprocatively moveable through the hole, the first biased spring attached at one end to the upper end of the housing and at the other end to the support rod, the support rod has an annular disk extending radially outwardly from a portion of the support rod distal the free end, the annular disk dividing the chamber into two chambers, a steam chamber extending from the adjacent the lower end of the housing and an air chamber, extending from adjacent the upper end of the housing, a steam inlet for receiving steam under pressure from an external steam source, via an inner steam pipe, for moving the support rod from the first position to the second position and for transferring steam away from the steam chamber, via the inner steam pipe when the support rod is moved from the first position to the second position by means of the first spring.

In accordance with a second specific application, the at least one biased spring comprises a single spring and the at least one actuating member comprises a solenoid that is mechanically coupled to the single spring.

Typically, an assembly of levers connected to a strut-like member communicates between the solenoid and the plurality of retractable support rods, to move the plurality of retractable support rods from the first position to the second position.

BRIEF DESCRIPTION OF THE DRAWINGS

For a better understanding the invention will now be described, by way of example only, with reference to the accompanying drawings in which.

DETAILED DESCRIPTION OF PREFERRED EMBODIMENTS

Figure 1:
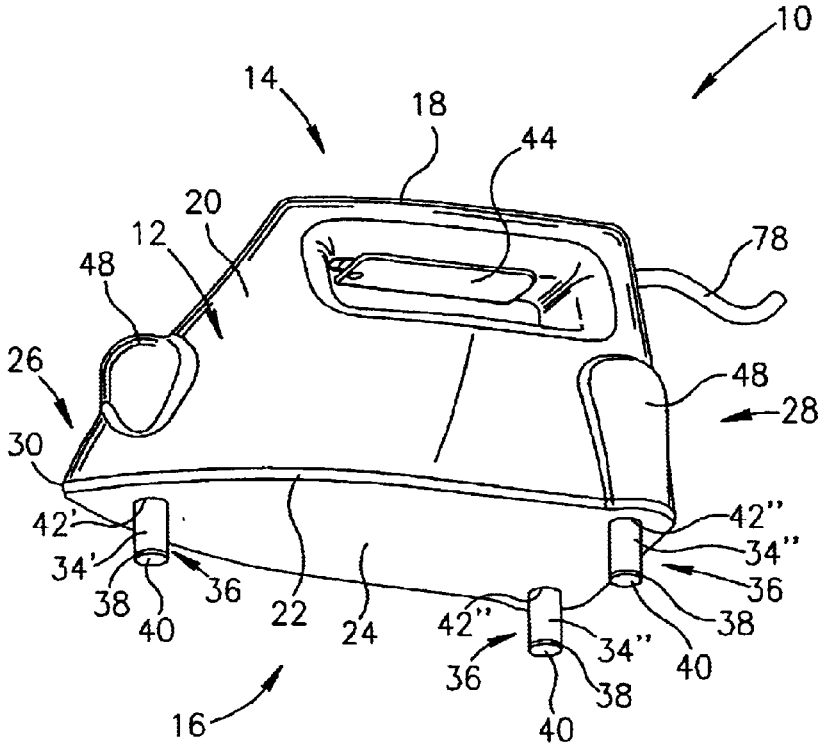
FIG. 1 is a bottom perspective view of the electric iron having retractable support rods in accordance with a first embodiment of a first specific application of the present invention showing the retractable support rods in an extended position.
Figure 2:
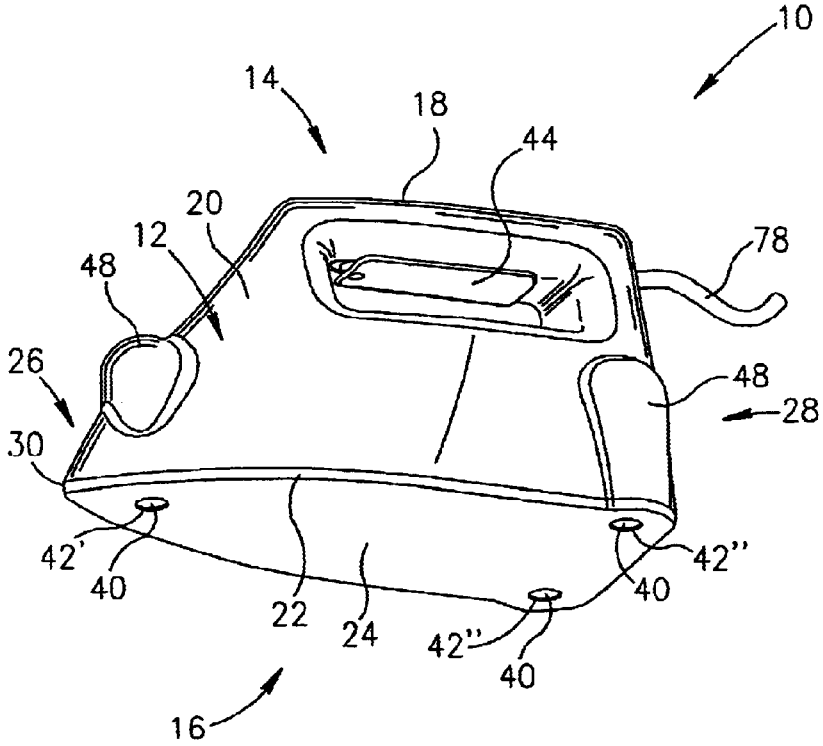
FIG. 2 is a bottom perspective view of the electric iron illustrated in FIG. 1 showing the retractable support rods in a retracted position.
Figure 3:
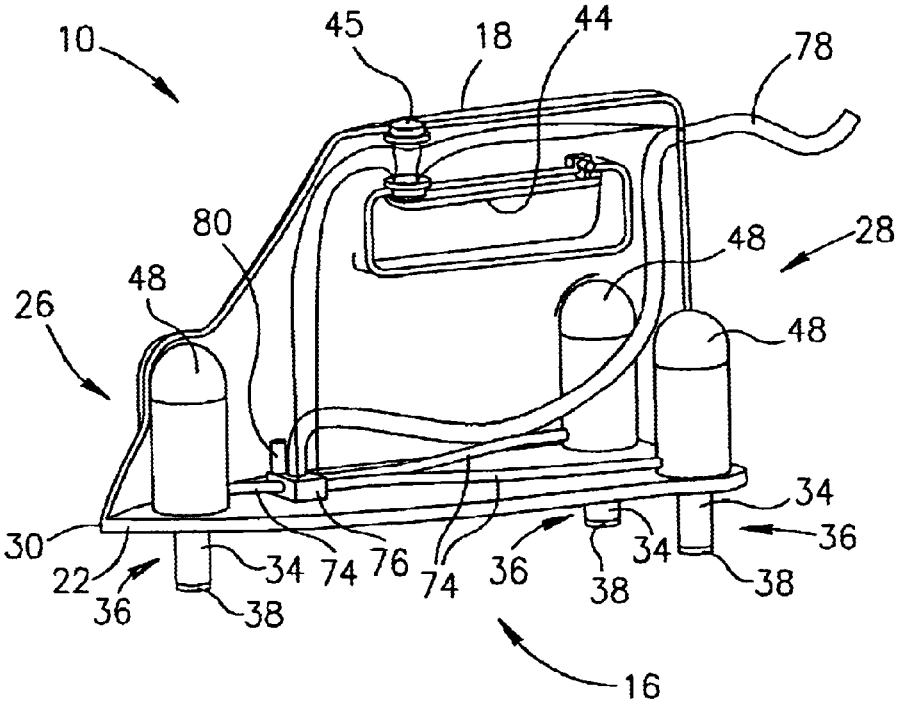
FIG. 3 is a side perspective view of the electric iron illustrated in FIG. 1 with the body cover removed showing the essential features of the inside of the iron.
Figure 4:
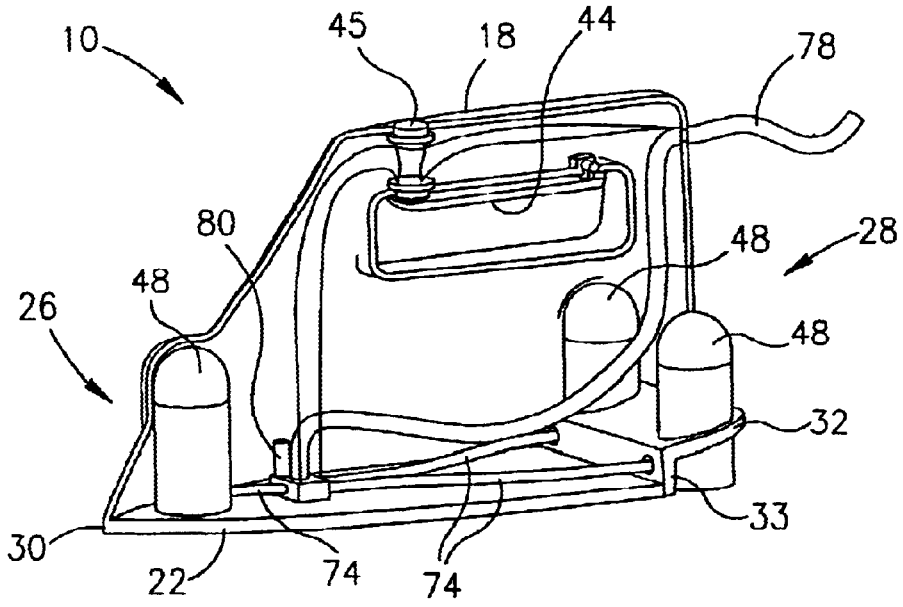
FIG. 4 is a side perspective view of the electric iron in accordance with a second embodiment of a first specific application of the present invention, with the body cover removed, showing the essential features of the inside of the iron.
Figure 5:
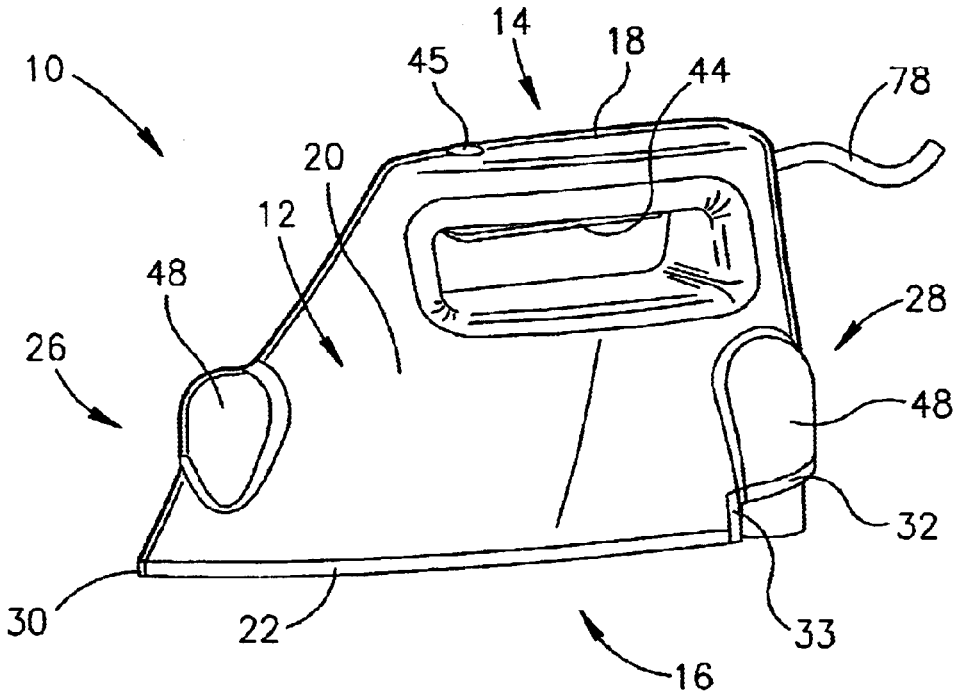
FIG. 5 is a side perspective view of the electric iron illustrated in FIG. 4.
Figure 6:
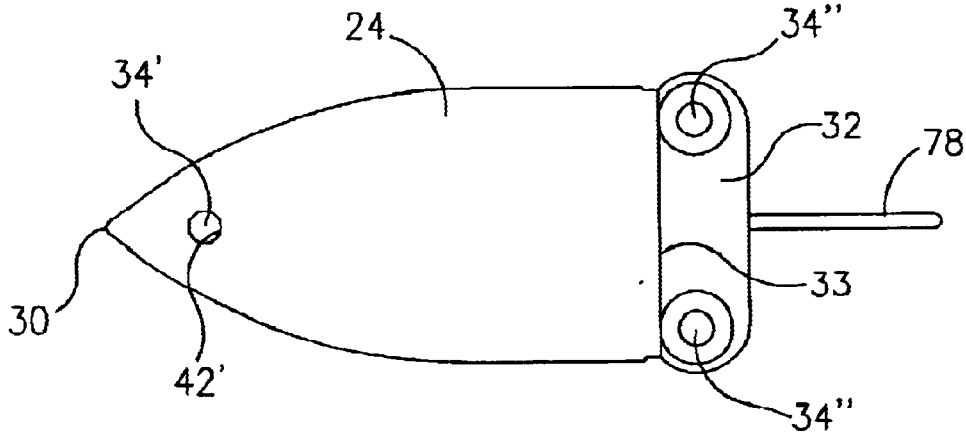
FIG. 6 is a bottom view of the soleplate of the electric iron illustrated in FIGS. 4 and 5.

Attention is drawn to FIGS. 1 to 6 showing an electric iron 10 in accordance with a first specific application of the present invention. The electric iron 10 has a body 12 having a top 14 and a bottom 16 and a handle 18 at the top of the body 12, to be gripped during use. A body cover 20 extends downwards from the handle 18 to a soleplate 22 having a bottom surface 24 for ironing an article. The iron 10 has a front 26 and a rear 28. At the front 26 of the iron 10 the soleplate 22 characteristically narrows to form a nose portion 30. In accordance with a first embodiment of the present invention, the soleplate 22 forms the bottom 16 of the body 12. Stated differently, and as can be seen in FIGS. 1 to 3, in accordance with the first embodiment the bottom surface 24 of the soleplate 22 extends over the whole area of the bottom 16 of the body 12 of the iron 10 from the front 26 of the iron to the rear 28 thereof. In accordance with a second embodiment of the present invention, the bottom 16 of the body 12 at the rear 28 of the iron 10 is provided with a raised section 32 having a step 33, so that the soleplate 22 comprises only a portion of the bottom 16 of the body 12. In other words, and as can be seen in FIGS. 4 to 6, in accordance with the second embodiment, the bottom surface 24 of the soleplate 22 only extends from the from the nose portion 30 at the front 26 of the iron 10 to the step 33 of the raised section 32. That is, the soleplate 22 it does not reach the rear 28 of the iron 10.

In accordance with the first specific application, the iron 10 is an electric steam iron of the type in which steam is supplied to the iron from an external steam source. Irons of this type are well known in the art and therefore the known features of such irons will not be illustrated or described herein. Such features relate, amongst other things, to the heating of the sole plate and the conveying of steam to the article being ironed through openings in the soleplate. However, as will described below, the steam which is supplied to the iron is also used in the first specific application of the present invention as a means to lift the iron from the article being ironed or from the ironing board cover.

In accordance with the first specific application of the present invention the bottom 16 of the body 12 is provided with three retractable support rods 34 that are movable from a first extended position in which they protrude from the bottom 16 of the body 12 beyond the bottom surface 24 of the soleplate 22, forming a stand for supporting the iron 10 in a horizontal stable position on free ends 36 of the retractable support rods 34 with the soleplate 22 removed from the article being ironed or from an ironing board cover, to a second retracted position in which they are located within the body 12. The retractable support rods 34 can be made from a metal or from a thermally insulating material. However, it should be kept in mind that when the retractable support rods 34 are located within the body 12 in the retracted position they will be in the vicinity of the hot soleplate 22. Therefore, if the retractable support rods 34 are made from a metal the will absorb heat from the surroundings when they are retracted. Therefore, in order not to damage the surface that the hot metal retractable support rods 34 abut when they are in the extended position after being in the retracted position, each metal support rod 34 is provided with a thermally insulating member 38 attached to its free end 36. Typically, the thermally insulating member 38 has a generally planar support surface 40 for abutting the article being ironed or the ironing board cover and for supporting the iron 10, when the retractable support rods are extended. Clearly, if the retractable support rods 34 are made from a thermally insulating material, then there is no reason to their free ends 36 with the thermally insulating members 38, in which case the free ends 36 of each support rod will have a generally planar support surface 40. Taking into account the shape of the iron 10 in general and of the soleplate 22 in particular, a first support rod 34' of the three retractable support rods 34 is positioned close to the front 26 of the iron 10 and two second retractable support rods 34" are positioned close to the rear 28 of the iron 10. When the retractable support rods 34 are in the retracted position, the support surfaces 40 are preferably substantially flush with, or slightly recessed from, the bottom surface 24 of the soleplate 22.

In accordance with the first embodiment of the first specific application of the present invention, when the three retractable support rods 34 are in the extended position, each support rod 34 protrudes through a bore 42 in the soleplate. In other words, since in accordance with the first embodiment the bottom surface 24 of the soleplate 22 extends over the whole area of the bottom 16 of the body 12 of the iron 10 all three bores 42 are located in the soleplate 22, with a first bore 42' located in the soleplate 22 close to the front 26 of the iron 10 and two second bores 42" located in the soleplate 22 close to the rear 28 of the iron 10. In accordance with the second embodiment of the first specific application of the present invention, when the three of retractable support rods 34 are in the extended position, the support rod 34' located at the front 26 of the iron 10 protrudes through the first bore 42' in the soleplate 22, and the two retractable support rods 34" located at the rear 28 of the iron 10 protrude from the raised section 32 of the bottom 16 of the body 12 exterior to the soleplate 22. Hence, in accordance with the second embodiment of the first specific application, there is only one bore 42 in the soleplate 22.

The retractable support rods 34 are operatively coupled to a support switch 44 located on the handle 18. The support switch 44 is movable from a first state when the handle 18 is not gripped to a second state when the handle is gripped. When the support switch 44 is in the first state the retractable support rods 34 are extended and when the support switch 44 is in the second state the retractable support rods 34 are retracted. The retractable support rods 34 are also operatively coupled to an on/off switch 45 located on the handle 18. The on/off switch 45 is used to switch the control the use of the support switch 44. In the normal mode of operation, i.e., the support legs 34 are retracted when the handle 18 is gripped and the support legs 34 are extended when the handle 18 is not gripped, the on/off switch 45 is turned "off". However, if it is desired to use the iron 10 with the retractable support rods 34 permanently retracted) then the on/off switch 45 is turned "on". In this mode of operation the support switch 44 is electrically by-passed and the retractable support rods 34 are permanently retracted independently of whether the handle 18 is gripped or not gripped.

Figure 7:
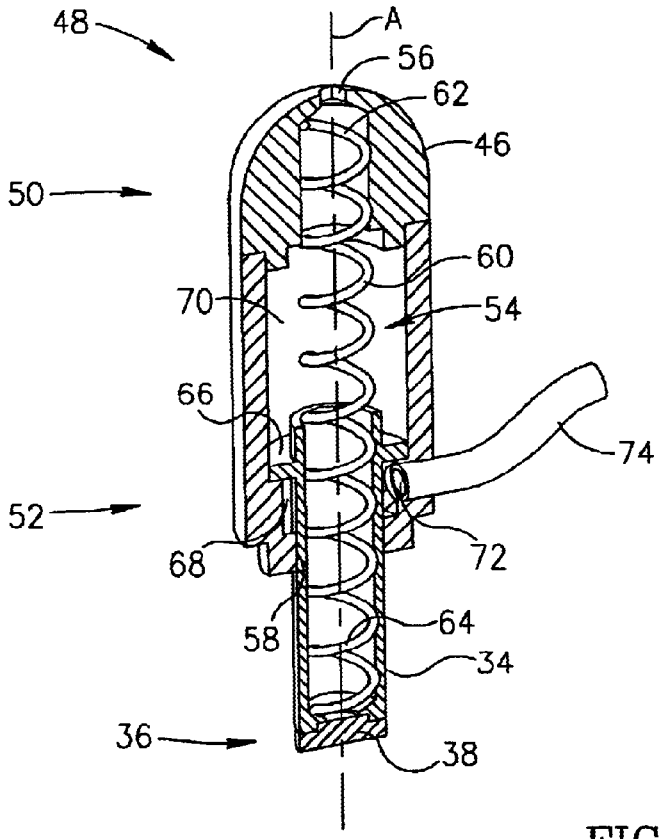
FIG. 7 is a side sectional view of a support unit in accordance with a first specific application of the present invention showing the support rod in an extended position.
Figure 8:
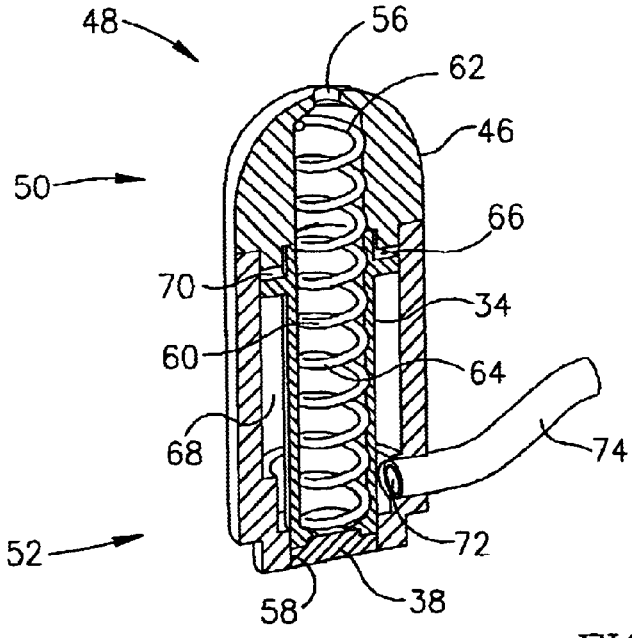
FIG. 8 is a side sectional view of a support unit in accordance with a first specific application of the present invention showing the support rod in a retracted position.

Attention is now drawn to FIGS. 7 and 8. In accordance with the first specific application of the present invention, each support rod 34 is mounted in a housing 46 of a support unit 48 for reciprocatory movement with respect to the housing 46. Each support unit 48 has a longitudinal axis A and comprises the housing 46 having an upper end 50 and a lower end 52, with a generally cylindrical longitudinally extending chamber 54, extending from the upper end 50 of the housing 46 to the lower end 52 thereof. The housing 46 also has an air outlet 56 at its upper end 50 and a circular opening 58 at its lower end 52. The support rod 34 is located in the chamber 54 with a first biased spring 60 attached to the upper end 50 of the housing 46 at a first end 62 of the spring 60 and to the support rod 34 at a second end 64 of the spring 60. The support rod 34 has an annular disk 66 extending radially outwardly from a portion of the support rod 34 distal the free end 36 thereof. The annular disk 66 divides the chamber 54 into two chambers; a steam chamber 68 extending from the adjacent the lower end 52 of the housing 46 towards the upper end 50 thereof and an air chamber 70 extending from adjacent the upper end 50 of the housing 46 towards the lower end 52 thereof. The annular disk 66 is constructed to isolate the air and steam chambers 70, 68 one from the other, so that steam under pressure in the steam chamber 68 cannot pass into the air chamber 70. The steam chamber 68 is provided with a steam inlet/outlet 72 for receiving steam under pressure from an external steam source (not shown) and also for transferring steam away from the steam chamber, via an inner steam pipe 74.

When the handle 18 of the iron 10 is not gripped, the support switch 44 is in a normally open position and a solenoid operated steam valve 76, operatively associated with the support switch 44, is in a normally closed position and no steam is conveyed to the steam chamber 68 so that the biased first spring 60 retains the support rod 34 in an extended position relative to the housing 46, as shown in FIG. 7. As can be seen, in this position, the air chamber 70 has a maximum size and the steam chamber 68 has a minimum size. When the handle 18 of the iron 10 is gripped, in order to iron an article, the state of the support switch 44 is changed to a closed position, whereby an electric current is established in the solenoid operated valve 76, operatively associated with the support switch 44, and the solenoid operated valve 76 is opened allowing steam to be conveyed to the steam chamber 68 via the inner steam pipe 74. Consequently, the steam pressure in the steam chamber 68 increases. As soon as the steam pressure is great enough to overcome the pressure applied by the first spring 60 on the support rod 34, then the size of the steam chamber 68 increases, as the steam applies pressure to the annular disk 66 and at the same time the size of the air chamber 70 decreases. As the size of the air chamber 70 decreases, air in the air chamber 70 is expelled through the air outlet 56. Clearly, as the size of the steam chamber 68 increases, the support rod 34 shortens in length as it passes through the circular opening 58, until the support rod is fully retracted and is located completely within the housing 46.

As can be seen in FIGS. 3 and 4, the solenoid-operated valve 76 is in operative association with all three support units 48 via the inner steam pipes 74. A steam input pipe 78 for receiving steam under pressure from an external steam source (not shown) is also connected to the solenoid operated valve 76. When the handle 18 of the iron 10 is gripped, in order to iron an article, and the state of the support switch 44 is changed to a closed position, steam to be conveyed to all three support units 48 by the inner steam pipes 74. Consequently, all three retractable support rods 34 retract until they are located completely within the housing 46. Similarly, when the handle 18 is released and the state of the support switch 44 is changed to an open position, the steam supply to al three support units 48 is cut off and all three retractable support rods 34 become fully extended. Also shown in FIGS. 3 and 4 is a return steam exit pipe 80 for the passage of steam from the steam chambers 68, as the steam chambers 68 decrease in size when the support members move from a retracted position to the extended position. The steam exiting the return steam exit pipe 80 can be conveyed to the article being ironed through openings in the soleplate 22. With reference to the on/off switch 45, it will be clear that when the on/off switch 45 is turned "off" then the support switch is in an operative mode. However, when the on/off switch 45 is turned "on" then the solenoid operated valve 76 is opened allowing steam to be conveyed to the support units 48 by the inner steam pipes 74. Consequently, the retractable support rods 34 will remain retracted as long as the on/off switch 45 is turned "on".

Figure 9:
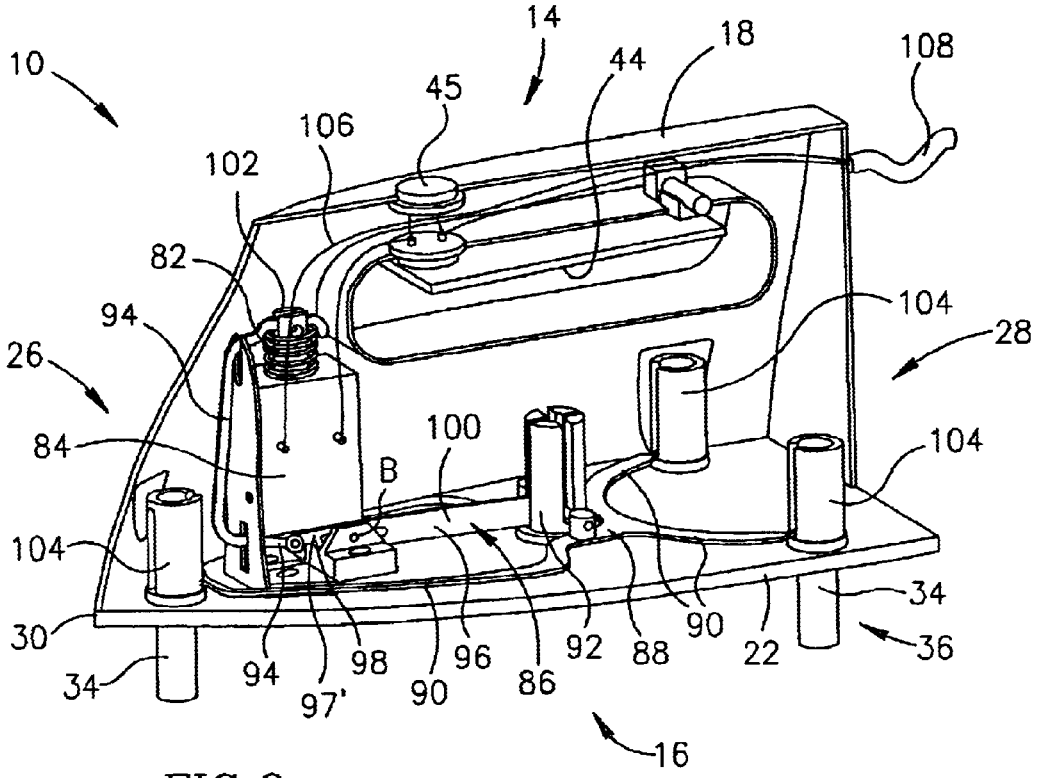
FIG. 9 is a side perspective view of the electric iron in accordance with a second specific application of the present invention, with the body cover removed, showing the retractable support rods in an extended position.
Figure 10:
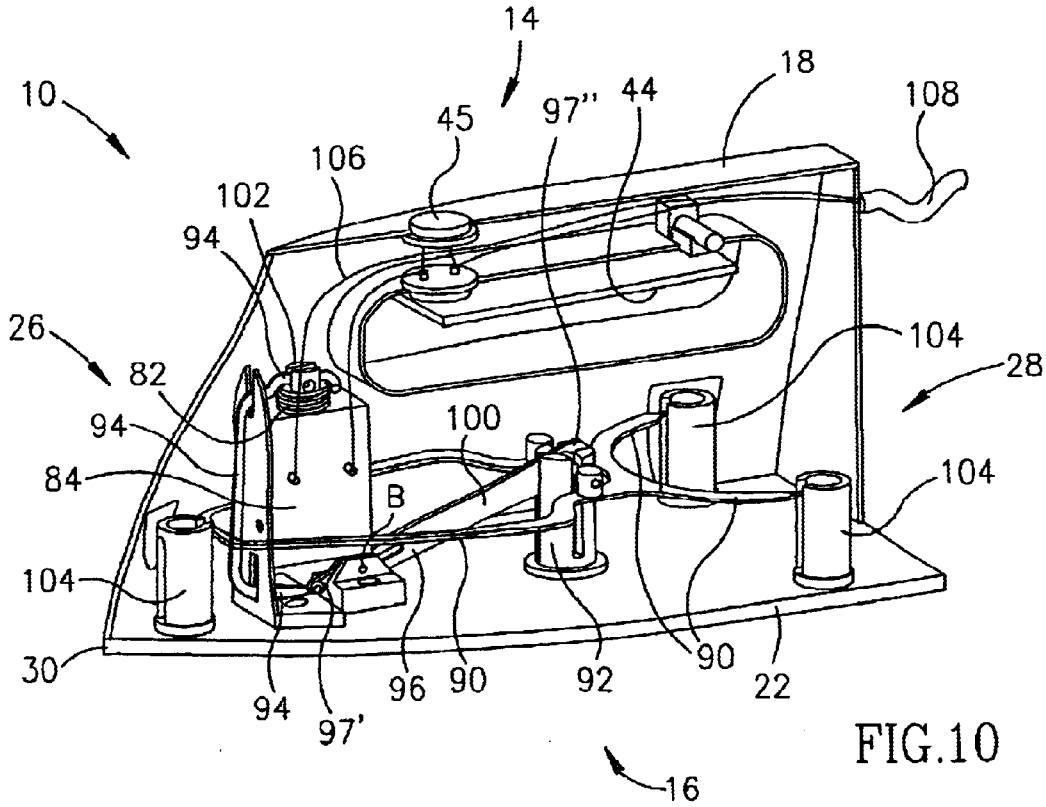
FIG. 10 is the view of the electric iron shown in FIG. 9 showing the retractable support rods in a retracted position.

Attention is now drawn to FIGS. 9 and 10 showing an electric iron in accordance with a second specific application of the present invention. As with the first specific application of the present invention, the bottom 16 of the body 12 of the iron 10, is provided with three retractable support rods 34 that are movable from a first extended position in which they protrude from the bottom 16 of the body 12 beyond the bottom surface 24 of the soleplate 22, forming a stand for supporting the iron 10 in a horizontal stable position on free ends 36 of the retractable support rods 34 with the soleplate 22 removed from the article being ironed or from an ironing board cover, to a second retracted position in which they are located within the body 12. Unlike the first specific application of the present invention, the iron 10 of the second specific application of the present invention does not operate by means of steam. Instead the retractable support rods 34 are moved from an extended position, as shown in FIG. 9, to a retracted position, as shown in FIG. 10, by means a single second spring 82 mechanically coupled to a solenoid 84 and in operative association with an assembly of levers 86 connected to a strut-like member 88. The strut like member 88 comprises three arms 90, each arm being connected to a support rod 34 via a central lifting unit 92.

The assembly of levers 86 comprises a hook-shaped first lever 94 pivotally connected to a straight second lever 96 at a first end 97' thereof. The second lever 96 comprises a short section 98 and a long section 100 and is pivotable about a pivot axis B located between the short and long sections 98, 100. The long section 100 is coupled, at a second end 97" of the second lever 96, to the strut-like member 88 at the central lifting unit 92. The solenoid 84 has solenoid core 102 that is coupled to both the hook-like first lever 94 and the second spring 82. It will be apparent to those skilled in the art that this particular arrangement of the assembly of levers 86 enables relatively small linear movements of the solenoid core 102 to be amplified to large enough linear movements in order to reciprocate the support members 34 between the extended and retracted positions.

When the handle 18 of the iron 10 is not gripped, the support switch 44 is in a normally open position and no electric current flows to the solenoid 84. In this situation the second spring 82 is biased and maximally extended, as shown in FIG. 9. The solenoid core 102 is retained by the second spring 82 protruding upwardly from the solenoid 84 and the first lever 94 is retained in a raised position. In this position, the second lever 96 is substantially horizontal, the strut-like member 88 is in a lowered position and the retractable support rods 34 are extended.

When the handle 18 of the iron 10 is gripped, in order to iron an article, the state of the support switch 44 is changed to a closed position, whereby an electric current is established in the solenoid 84 as a result of which the solenoid core 102 is urged downwardly into the solenoid 84. As the solenoid core 102 moves downwardly, the second spring 82 becomes compressed, the first end 97' of the second lever 96 is forced downwards towards the soleplate 22 by the first lever 94, whereby the second lever 96 rotates about the pivot axis B and the second end 97' of the second lever 96 moves upwards away from the soleplate 22 taking with it the strut-like member 88. Consequently, as the strut-like member 88 moves upwards, the support members 34 retract from their extended position until they are located completely within the body of the body 12 of the iron 10, with each support member 34 located within a cylindrical container 104, as shown in FIG. 10.

As with the first specific application, an "on/off" switch 45 is also provided on the handle 18 of the iron 10. The "on/off" switch 45 is connected by electric wires 106 to the solenoid 84 and the electric iron is connected to an external electric power supply via an electric cable 108. As with the first specific application, if it is desired to use the iron 10 with the retractable support rods 34 permanently retracted, then the on/off switch 45 is turned "on" and an electric current is supplied to the solenoid 84 causing the support legs 34 to be retracted. In this mode of operation the support switch 44 is electrically by-passed and the retractable support rods 34 are permanently retracted independently of whether the handle 18 is gripped or not gripped.

Although the present invention has been described to a certain degree of particularity, it should be understood that various modifications and alterations can be made without departing from the spirit or scope of the invention as hereinafter claimed.

What is claimed is:

1. A self-lifting electric iron comprising:

a body having a top and a bottom;

a soleplate comprising at least a portion of the bottom of the body, the soleplate having a bottom surface for ironing an article;

the bottom of the body being provided with a plurality of retractable support rods that are movable from a first position in which the retractable support rods protrude from the bottom of the body beyond the bottom surface, forming a stand for supporting the iron in a horizontal stable position with the soleplate removed from the article being ironed or from an ironing board cover, to a second position in which the plurality of retractable support rods are located within the body;

a handle at the top of the body, to be gripped during use; and a support switch located on die handle with the support switch being in a first state and the plurality of retractable support rods in the first position when the handle is not gripped, and when the handle is gripped the support switch changes state to a second state and the plurality of retractable support rods move to the second position;

wherein each support rod is mounted in a housing for reciprocatory movement with respect to the housing, with the plurality of retractable support rods being maintained in the first position by means of at least one biased spring, and with the plurality of retractable support rods being moved from the first position to the second position by means of at least one actuating member;

wherein the at least one biased spring comprises a plurality of first springs, each support rod of the plurality of retractable support rods being in operative association with a separate single first spring of the plurality of first springs and the at least one actuating member comprises a plurality of support units; and wherein each support unit has a longitudinal axis and comprises the housing, the housing having a upper and lower ends, with a generally cylindrical longitudinally extending chamber, extending from the upper end of the housing the lower end of the housing, an air outlet at the upper end of the housing and a circular opening at the lower end of the housing, the support rod being located in the chamber and reciprocatively moveable through the hole, the first biased spring attached at one end to the upper end of the housing and at the other end to the support rod, the support rod has an annular disk extending radially outwardly from a portion of the support rod distal the free end, the annular disk dividing the chamber into two chambers, a steam chamber extending from the adjacent the lower end of the housing and an air chamber, extending from adjacent the upper end of the housing, a steam inlet for receiving steam under pressure from an external steam source, via an inner steam pipe, for moving the support rod from the first position to the second position and for transferring steam away from the steam chamber, via the inner steam pipe when the support rod is moved from the first position to the second position by means of the first swing.

2. The self-lifting iron according to claim 1, wherein the plurality of retractable support rods comprises three retractable support rods.

3. The self-lifting iron according to claim 2, wherein one support rod of the three retractable support rods is located at a front end of the iron and two retractable support rods of the three retractable support rods are located at a rear end of the iron.

4. The self-lifting iron according to claim 3, wherein when the three retractable support rods are in the first position, each of the retractable support rods protrudes through a bore in the soleplate.

5. The self-lifting iron according to claim 4, wherein the three retractable support rods remade of a thermally insulating material.

6. The self lifting iron according to claim 3, wherein when the retractable support rods are in the first position, the one support rod located at the front end of the iron protrudes through a bore in the soleplate, and the two retractable support rods located at the rear of the iron protrude from a portion of the bottom of the body exterior to the soleplate.

7. The self-lifting iron according to claim 6, wherein in the first position each support rod has a free end distal the soleplate and each support rod is provided with a thermally insulating member attached to the free end thereof, the thermally insulating member having a generally planar support surface for abutting the article being ironed or the ironing board cover and for supporting the iron, when the support rod is in the first position.

8. The self-lifting iron according to claim 4, wherein when each support rod is in the second position, the support surfaces are substantially flush with the bottom surface of the soleplate.

9. The self-lifting iron according to claim 1, further comprising an on/off switch, said on/off switch having a position in which the support switch is bypassed and the retractable support rods are retracted independently of whether the handle is gripped or not gripped.

10. A self-lifting electric iron comprising:

a body having a top and a bottom;

a soleplate comprising at least a portion of the bottom of the body, the soleplate having a bottom surface for ironing an article;

the bottom of the body being provided with a plurality of retractable support rods that are movable from a first position in which the retractable support rods protrude from the bottom of the body beyond the bottom surface, forming a stand for supporting the iron in a horizontal stable position with the soleplate removed from the article being ironed or from an ironing board cover, to a second position in which the plurality of retractable support rods are located within the body;

a handle at the top of the body, to be gripped during use; and a support switch located on the handle with the support switch being in a first state and the plurality of retractable support rods in the first position when the handle is not gripped, and when the handle is gripped the support switch changes state to a second state and the plurality of retractable support rods move to the second position;

wherein each support rod is mounted in a housing for reciprocatory movement with respect to the housing, with the plurality of retractable support rods being maintained in the first position by means of at least one biased spring, and with the plurality of retractable support rods being moved from the first position to the second position by means of at least one actuating member;

wherein the at least one biased spring comprises a single spring and the at least one actuating member comprises a solenoid that is mechanically coupled to the single spring.

11. The self-lifting iron according to claim 10, wherein an assembly of lovers connected to a strut-like member communicates between the solenoid and the plurality of retractable support rods, to move the plurality of retractable support rods from the first position to the second position.

12. The self-lifting iron according to claim 10, wherein the plurality of retractable support comprises three retractable support rods.

13. The self-lifting iron according to claim 12, wherein one support rod of the three retractable support rods is located at a front end of the iron and two retractable support rods of the three retractable support rods are located at a rear end of the iron.

14. The self-lifting iron according to claim 13, wherein when the three retractable support rods are in the first position, each of the retractable support rods protrudes through a bore in the soleplate.

15. The self-lifting iron according to claim 14, wherein the three retractable support rods are made of a thermally insulating material.

16. The self-lifting iron according to claim 13, wherein when the retractable support rods are in the first position, the one support rod located at the front end of the iron protrudes through a bore in the soleplate, and the two retractable support rods located at the rear of the iron protrude from a portion of the bottom of the body exterior to the soleplate.

17. The self-lifting iron according to claim 16, wherein in the first position each support rod has a free end distal the soleplate and each support rod is provided with a thermally insulating member attached to the free end thereof, the thermally insulating member having a generally planar support surface for abutting the article being ironed or the ironing board cover and for supporting the iron, when the support rod is in the first position.

18. The self-lifting iron according to claim 14, wherein when each support rod is in the second position, the support surfaces are substantially flush with the bottom surface of the soleplate.

19. The self-lifting iron according to claim 10, further comprising an on/off switch, said on/off switch having a position in which the support switch is bypassed and the retractable support rods are retracted independently of whether the handle is gripped or not gripped.

* * * * *